United States Patent [19]

Winter et al.

[11] Patent Number: 4,852,839

[45] Date of Patent: Aug. 1, 1989

[54] TUBULAR SUPPORT DISPLAY SYSTEM

[75] Inventors: Russell K. Winter, Crownsville; Thomas D. Harvey, Rockville; Richard S. Kain, Woodbine; Nedim Savas, Bethesda, all of Md.

[73] Assignee: Russell William, Ltd., Odenton, Md.

[21] Appl. No.: 174,890

[22] Filed: Mar. 29, 1988

[51] Int. Cl.[4] ..... A47G 29/02

[52] U.S. Cl. ..... 248/225.1; 248/243; 211/192

[58] Field of Search ..... 248/225.1, 243, 231.9, 248/250, 235, 239, 224.4, 188, 218.4; 211/187, 208, 192, 193, 107, 182, 183; 108/108, 107

[56] References Cited

U.S. PATENT DOCUMENTS

| | | | |
|---|---|---|---|
| 1,760,503 | 5/1930 | Knape | 248/243 |
| 1,941,838 | 1/1934 | Hyams | 108/108 |
| 2,788,902 | 4/1957 | Nowicki | 248/243 X |
| 2,928,512 | 3/1960 | Slater et al. | 248/243 X |
| 3,143,981 | 8/1964 | Tassell | 108/108 |
| 3,190,454 | 6/1965 | Brooks | 248/243 X |
| 3,468,428 | 9/1969 | Riebold | 248/218.4 X |
| 3,652,048 | 3/1972 | Hartman | 248/243 |
| 3,749,343 | 7/1973 | Marschak | 248/188 |

FOREIGN PATENT DOCUMENTS

| | | | |
|---|---|---|---|
| 17336 | 12/1906 | United Kingdom | 248/243 |

*Primary Examiner*—Ramon S. Britts
*Assistant Examiner*—Karen J. Chotkowski
*Attorney, Agent, or Firm*—Morton J. Rosenberg

[57] ABSTRACT

A tubular support display system (10) is provided for displaying articles mounted thereon. The tubular support display system (10) includes at least one tubular post member (20) having at least one slotted through opening (22) formed therein. A display member (30) is releasably coupled to the tubular post member by an attachment system (40). The attachment system (40) includes a plate member (42), a fastening assembly (50), and at least one pin member (60). Display member (30) is fixedly coupled to a first surface (44) of plate member (42), while pin member (60) is fixedly coupled on a second surface (46) of plate member (42). The fastening assembly (50) includes a head member (52) coupled to a threaded member (54), having an opposing end (55) to which a clamp member (56) is threadedly coupled. Treaded member (54) passes through an opening (48) formed in plate member (42) and passing between first surface (44) and second surface (46). Plate member (42) is clamped to tubular post member (20) by inserting clamp member (56) and pin member (60) into the tubular post cavity (26) by passing through the slotted opening (22); rotating clamp member (56) approximately 90°; retracting the fastening assembly (50) such that clamp member (56) rests against the inner surface (24) of tubular post member (20); and, rotating threaded member (54) to draw head member (52) toward clamp member (56), thereby clamping plate member (42) and display member (30), attached thereon, to tubular post member (20).

5 Claims, 2 Drawing Sheets

3ULAR SUPPORT DISPLAY SYSTEM

BACKGROUND OF THE INVENTION

1. Field of the Invention

This invention directs itself to a tubular support display system for displaying articles mounted thereon. In particular, this invention directs itself to a modular and prefabricated type tubular support display system which includes the advantages of simplicity of construction and packaging for shipment. Still further, this invention directs itself to a display system which maximizes viewing of articles contained thereon without distracting from the aesthetics of the viewed articles. More in particular, this invention pertains to display systems which have tubular elements interconnected to create a custom support structure. Further, this invention directs itself to a display system which allows for article support members to be mounted at any of a variety of elevations or angular positions relative to a support post, from which unique and versatile display structures can be created.

2. Prior Art

Display systems are well-known in the art. Display systems having support members which are tubular and have slotted through openings are also well-known in the art. The slotted through openings of such prior art systems allow for display members to be slidingly coupled thereto. Such coupling provides support against forces directed vertically downward, but offer little or no resistance to forces directed vertically upward and marginal resistance to laterally directed forces, whereas in the subject invention concept, the display member is clampingly engaged to the tubular post member, providing superior resistance to both vertical and lateral forces.

Other prior art display systems although providing for a slot support insert do not rely on a clamping member predetermined orientation for securement. Additionally, such prior art display systems do not use the clamping member in combination with restraining pins to increase the overall structural integrity of the display system.

SUMMARY OF THE INVENTION

A tubular support display system for supporting articles to be displayed thereon is provided. The tubular support display system includes at least one tubular post member having at least one through opening with a slotted contour formed therein. The display system further includes at least one display member releasably coupled to the tubular post member. The display system additionally includes a system for clampingly engaging the display member to the tubular post member in a releasable manner.

DESCRIPTION OF THE PREFERRED EMBODIMENTS

Referring now to FIGS. 1–4, there is shown tubular support display system 10 for displaying articles mounted thereon. As will be seen in following paragraphs, display system 10 is specifically directed to the concept of providing a structurally sound and aesthetically pleasing display system 10. Display system 10 has the capability of accepting interchangeable display members 30 to provide a wide variety of visual designs and effects utilizing the same basic design structure.

Although not restricted to commercial utilization, tubular support display system 10 is particularly adapted for use as a display type system in commercial establishments where it is desired to periodically vary the display to the viewing public, while simultaneously maintaining a low display cost. Additionally, display system 10 provides for a visually attractive system and allows for the system to act as a structural support for articles mounted thereon. Further, display system 10 can be configured in a wide variety of arrangements producing freestanding structures, mobile units, or units suspended from walls or ceilings.

Figure 1:
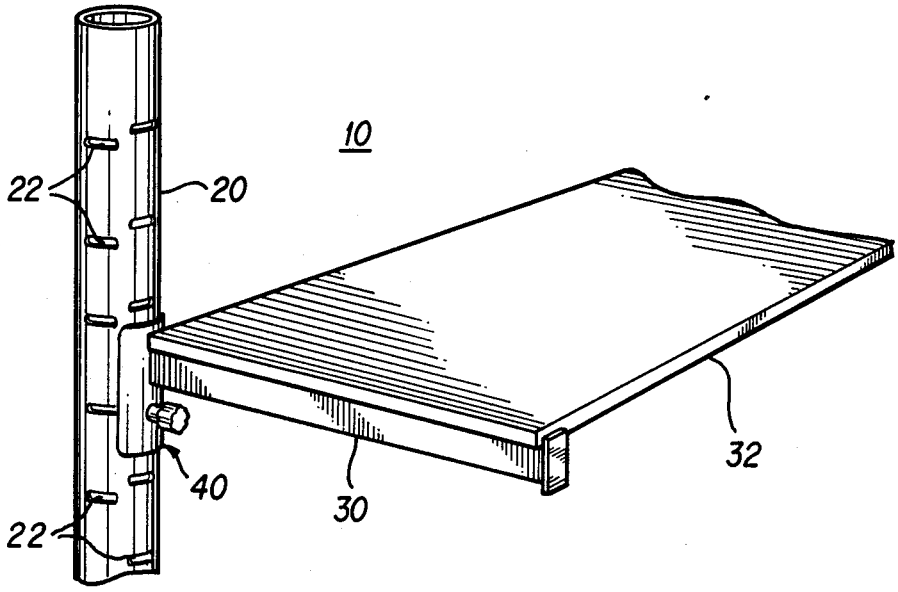
FIG. 1 is a perspective view of the tubular support display system.

Tubular support display system 10 includes one or more tubular post members 20, as shown in FIG. 1. In the Figure, display system 10 is shown to include tubular post member 20, display member 30, and attachment system 40. Although display member 30 is shown supporting one end of a shelf 32, such is exemplary only. Display member 30 may take the form of a wide variety of brackets and display supports, not important to the inventive concept as herein described.

Attachment system 40 provides means for coupling display member 30 to tubular post member 20. Display member 30 is fixedly coupled to attachment system 40, which provides a novel mechanism for releasable coupling between tubular post member 20 and display member 30, through at least one slotted opening 22 formed therein.

As shown in FIG. 1, tubular post member 20 may be cylindrically shaped with a substantially circular cross-section, however, other tubular shapes would perform as well. The number and location of openings 22 formed in tubular post member 20 are determined by the specific design of the display structure, and not important to the inventive concept as herein described. It is only important that tubular post member 20 have at least one opening 22 having a slot like contour where the opening length is greater than the opening width through which a clamping engagement is accomplished by attachment system 40, as will be described in following paragraphs.

Figure 2:
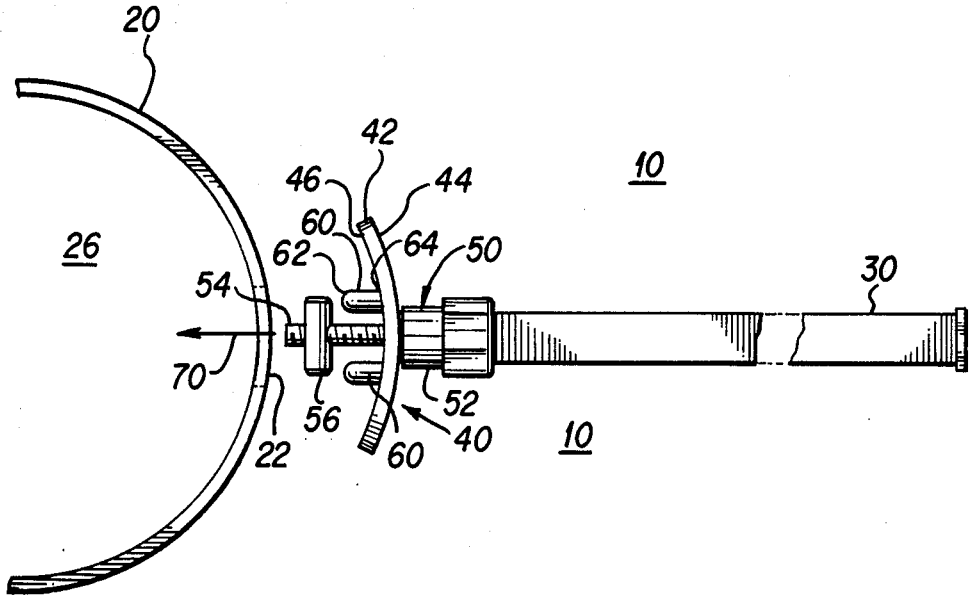
FIG. 2 is a cut-away sectional view of the tubular support display system showing the display member prior to attachment to the post member.

Referring now to FIG. 2, there is shown a cutaway view of tubular support display system 10. As shown, attachment system 40 includes plate member 42 having outer surface 44 to which display member 30 is fixedly attached. Display member 30 may be secured to plate member 42 by any of a wide variety of attachment techniques, well-known in the art. Such methods may include adhesive bonding, welding, riveting, or some like technique. Additionally, display member 30 and plate member 42 may be fabricated as a one-piece formation without departing from the spirit and scope of the inventive concept as herein described.

Attachment system 40 further includes at least one pin member 60 fixedly coupled to inner surface 46 of plate member 42. Although the illustrative embodiment shown in FIG. 2 includes a pair of pin members 60, only a single pin member 60 is required to carry out the inventive concept disclosed herein. Pin members 60 are cylindrically shaped projections having a first end 62 which is dome-shaped, and a second end 64 fixedly coupled to second surface 46 of plate member 42. Pin members 60 are located adjacent fastener assembly 50 for insert into the slotted opening 22 in tubular post member 20.

Fastening assembly 50 includes head member 52 coupled to a threaded member 54. Threaded member 54 passes through opening 48 formed through plate member 42 for threaded engagement with clamp member 56. Through opening 48 extends between first surface 44 and second surface 46 of plate member 42 and is centrally located between pin members 60. Through opening 48 is of a predetermined diameter, greater than the outside diameter of threaded member 54 but less than the outside diameter of head member 52 or the length of clamp member 56. For the embodiment shown, head member 52 is fixedly coupled to threaded member 54 with clamp member 56 being in threaded engagement with threaded member 54. It is contemplated however that such could be reversed with head member 52 being in threaded engagement with threaded member 54 while clamp member 56 would then be fixedly secured to the opposing end of threaded member 54 without departing from the inventive concept as herein described.

Figure 3:
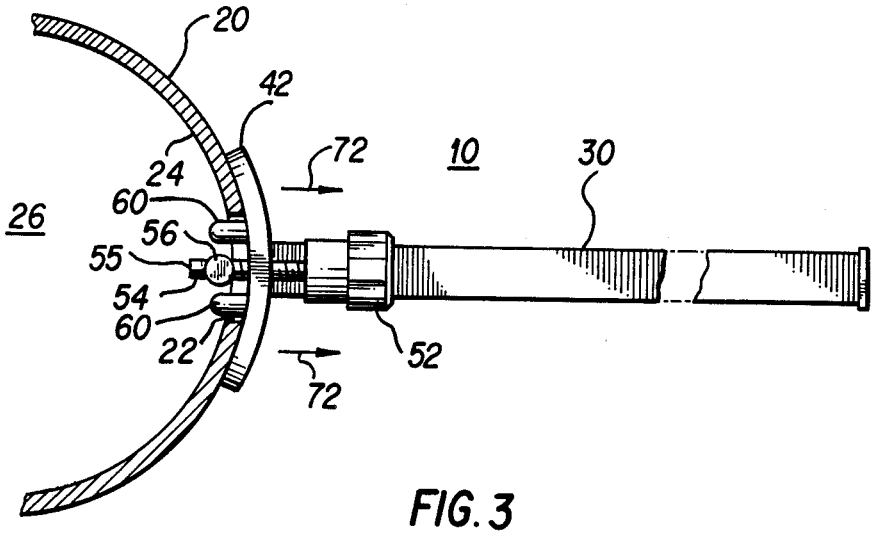
FIG. 3 is a cut-away sectional view of the display system showing the clamp member engaged prior to tightening of the fastener assembly; and, FIG. 4 is a longitudinal cut-away of the tubular support display system showing the clamping engagement of the attachment system.

In operation, as further shown in FIGS. 2 and 3, display system 10 is coupled to tubular post member 20 by insertion of clamp member 56 and pin member 60 into the slotted through opening 22 by directing attachment system 40 in the direction indicated by arrow 70 toward the interior cavity 26 of tubular post member 20. For such insertion to take place, clamp member 56 must be oriented such that its length is substantially parallel to the opening length of the slotted opening 22.

Once clamp member 56 has been inserted into the cavity 26 of tubular post member 20, clamp member 54 is rotated approximately 90°, as shown in FIG. 3. Following rotation of clamp member 56, head member 52 is pulled away from plate member 42 while plate member 42 is maintained in contiguous contact with tubular post member 20, as indicated by direction arrows 72, to provide a frictional engagement between clamp member 56 and the inner surface 24 of tubular post member 20. Head member 52 can thus be drawn toward plate member 42 by rotation of threaded member 54, responsive to a rotation of head member 52 to which it is coupled. As this tightening process progresses, clamp member 56 may have a tendency to rotate, but such is prevented by the blocking action of pin members 60 which have clamp member 56 captured therebetween.

Pin member 60 has two important purposes: (1) resistance to rotational forces applied to display system 10, and, (2) blocking clamp member 56 to prevent its rotation in response to the tightening torque applied through threaded member 54 and head member 52. Obviously, a single pin member 60 can carry out these functions. However, providing a pair of pin members 60 adds a level of redundancy, providing a high quality design which is better able to compensate for manufacturing tolerances and withstand customer abuse.

Figure 4:
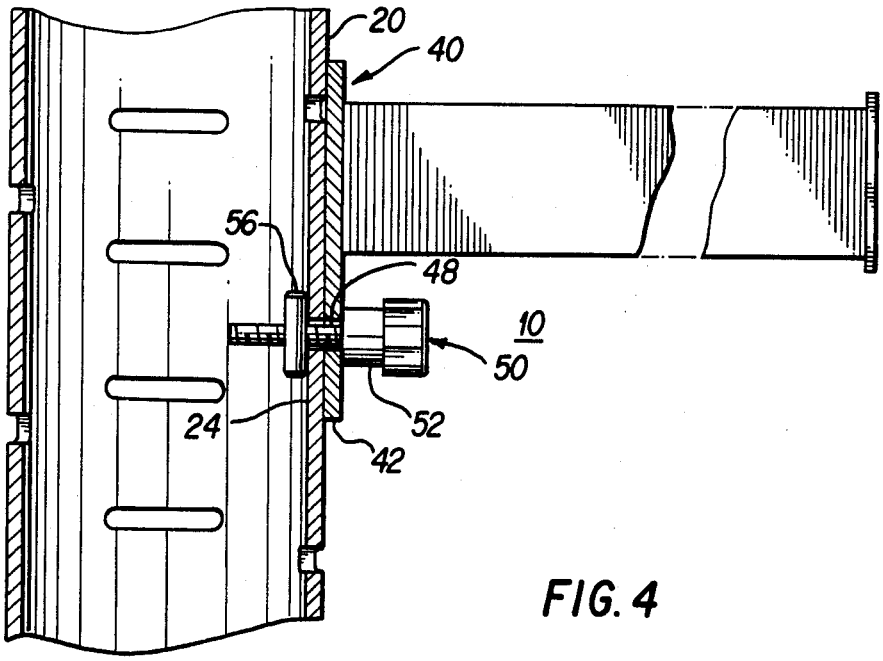

Referring now to FIG. 4, there is shown a longitudinal cut-away of attachment system 40 clampingly engaged to tubular post member 20. As shown, plate member 42 is clamped to tubular post member 20 between head member 52 and clamp member 56 of fastening assembly 50. The compressive forces applied to plate member 42 by fastening assembly 50 provide a secure and reliable coupling of display member 30 to tubular post member 20 through attachment system 40. The coupling is releasable, as the steps required to clamp plate member 42 to tubular post member 20 can be reversed to separate display member 30 from tubular post member 20.

As seen in FIGS. 1 and 2, display system 10 includes a novel means for clampingly engaging display member 30 to tubular post member 20 in a releasable manner. This unique clamping means is provided by attachment system 40, to which display member 30 is coupled. As previously described, display member 30 is joined to attachment system 40 on outer surface 44 of plate member 42, and fixedly coupled thereto.

Since the clamping engagement provided by attachment system 40 operates in combination with the slotted opening 22, a wide variety of display configurations are possible. Thus, having a plurality of slotted openings disposed vertically through tubular post member 20 allows for vertical height adjustment of display member 30, while slotted openings located radially about the tubular post member 20 permits one or more of display member 30 to be coupled to tubular post member 20 from various angles utilizing the inventive concept.

Plate member 42 of attachment system 40 has an arcuate shape, such that inner surface 46 has a contour and radius which substantially matches that of the outer surface of tubular post member 20. This arrangement improves axial rotation resistance of display member 30. Thus, when plate member 42 is clampingly engaged to tubular post member 20, as shown in FIG. 4, axial rotation of display member 30 is prevented by both the arcuate shape of plate member 42 and pin members 60. The resistance to rotation created by the arcuate shape of plate member 42 is an important feature of tubular support display system 10 since display member 30 is coupled to plate member 42 some distance from the fastening assembly 50 which clampingly engages plate member 42 to tubular post member 20. Hence, tight tolerances between the diameter of pin members 60 and the opening width of slotted opening 22 need not be maintained, since the arcuate shape of plate member 42 provides resistance to rotational displacement relative to tubular post member 20, all along its length when clamped between clamp member 56 and head member 52.

To improve the operability of attachment system 40, pin member 60 includes a dome-shaped first end 62. The domed end 62 is an important feature of attachment system 40 and insures a blocking engagement of pin member 60 with clamp member 56. The curved contour of the domed first end 62 of pin 60 provides a reduced contact area between clamp member 56 and pin 60, thus preventing clamp member 56 from being inadvertently clamped between first end 62 of pin member 60 and head member 52, as might occur if first end 52 were flat.

Referring now to FIGS. 2, 3, and 4, there is shown the method by which attachment system 40 couples display member 30 to tubular post member 20. Clamp member 56 is oriented substantially parallel to the opening length of slotted opening 22, thus allowing clamp member 56 to pass through slotted opening 22 into the tubular post cavity 26. Subsequently, the entire attachment system 40 is moved in the direction indicated by arrow 70 such that pin members 60, located adjacent through opening 48 through which threaded member 54 passes, pass into slotted opening 22, and inner surface 46 of plate member 42 is in contiguous contact with tubular post member 20. Clamp member 56 is then rotated approximately 90° such that it will no longer pass through slotted opening 22, followed by retraction of fastening assembly 50 as indicated by direction arrows 72. This provides a frictional engagement between clamp member 56 and the inner surface 24 of tubular post member 20, permitting rotation of threaded member 54 by head member 52. Although head member 52 is shown as a thumb screw type structure, such could be any of the well-known type fastener head structures used to drive threaded fasteners and well-known in the art.

Rotation of threaded member 54 causes head member 52 to be drawn closer to outer surface 44 of plate member 42, and such is continued until plate member 42 is clamped to tubular post member 20 between clamp member 56 and head member 52. Should the torque applied to head member 52 overcome the frictional force which maintains clamp member 56 in its rotated position, clamp member 56 would begin to rotate. However, this rotation would be blocked by at least one pin member 60 which passes through slotted opening 22 adjacent threaded member 54.

To disengage display member 30 from tubular post member 20, the foregoing procedure is reversed. However, it should be noted that the threads at end 55 of threaded member 54 are off-set such that clamp member 56 cannot be disengaged from threaded member 54. Thus, as attachment system 40 is loosened by rotation of threaded member 54 in a direction opposite to that which tightened and clamped the assembly, threaded member 54 will rotate freely until end 55 reaches clamp member 56. Once clamp member 56 reaches end 55 of threaded member 54, it can be rotated to the substantially parallel orientation with the opening length of slotted opening 22, subsequent to withdrawal of pin members 60.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or scope of the invention as defined in the appended claims.

What is claimed is:

1. A display system having at least one display element releasably coupled to a support member, comprising means for clampingly engaging said display element to said support member through an aperture in said support member; said aperture having a slot contour, said means for clampingly engaging including (1) a plate member having a through opening formed therein and extending between opposing first and second surfaces, (2) at least one cylindrically shaped pin member fixedly coupled to said second surface of said plate member adjacent said plate member through opening on a first end thereof, said pin member being oriented for insertion into said aperture in said support member and having predetermined dimensions relative to said aperture to substantially prevent rotation of said display element relative to said support member, and (3) fastening means slidingly coupled to said plate member for releasably coupling said plate member to said support member, said fastening means including:

a threaded member extending through said plate member through opening for insert into said support member aperture;

a head member fixedly coupled to a first end of said threaded member, and, a clamp member threadedly coupled to a second end of said threaded member and having a shape adapted for (1) passage through said slot contour of said support member aperture when said clamp member is oriented substantially parallel to an opening length of said aperture, and (2) preventing said passage of said clamp member through said aperture when said orientation is substantially non-parallel, said pin member being formed with a dome shaped contour on a second end thereof, whereby said clamp member is substantially prevented from inadvertently being lockingly held in contiguous contact with said dome shaped second end of said pin member.

2. The tubular support display system as recited in claim 1 where said display element is fixedly coupled to said plate member on said first surface thereof.

3. The tubular support display system as recited in claim 1 where said clamp member is lockingly held in contiguous contact with an inner surface of said support member subsequent to (1) insertion into said aperture in said support member, (2) blockingly engaging said clamp member against said pin member, and (3) drawing said clamp member toward said head member by rotation of said threaded member; said plate member being secured between said head member and said support member.

4. The tubular support display system as recited in claim 1 where said support member is cylindrically shaped and having a substantially circular cross-section of predetermined radius.

5. The tubular support display system as recited in claim 4 where said second surface of said plate member has an arcuate contour of a radius corresponding to said predetermined radius of said support member.

* * * * *